United States Patent [19]

Gaudio

[11] Patent Number: 4,498,075

[45] Date of Patent: Feb. 5, 1985

[54] FAULT INDICATOR APPARATUS FOR A MULTI-ZONE INTRUSION SYSTEM

[75] Inventor: Raymond Gaudio, Maspeth, N.Y.

[73] Assignee: Napco Security Systems, Inc., Copiague, N.Y.

[21] Appl. No.: 421,860

[22] Filed: Sep. 23, 1982

[51] Int. Cl.[3] ..... G08B 25/00

[52] U.S. Cl. ..... 340/525; 340/505; 340/524; 340/517; 340/331; 340/309.3; 340/825.17; 340/825.36

[58] Field of Search ..... 340/525, 524, 500, 506, 340/505, 512, 517, 518, 286 R, 521–523, 286 M, 825.06, 825.1, 825.11, 825.15, 825.17, 825.34, 825.36, 825.49, 825.55, 309.14, 309.3, 309.4, 330–332

[56] References Cited

U.S. PATENT DOCUMENTS

| | | | |
|---|---|---|---|
| 2,980,898 | 4/1961 | Mason et al. | 340/525 |
| 3,155,950 | 11/1964 | Foster | 340/525 |
| 3,823,383 | 7/1974 | Mallinger | 340/670 |
| 3,852,718 | 12/1974 | De Lyria | 340/286 |
| 3,940,739 | 2/1976 | Quimet | 340/525 |
| 4,223,302 | 9/1980 | Hocking | 340/525 |

*Primary Examiner*—Donnie L. Crosland
*Attorney, Agent, or Firm*—Arthur L. Plevy

[57] ABSTRACT

A fault indicator apparatus employs a single indicating device such as a light emitting diode (LED) to provide an indication of all zones within a plurality of zones which exhibit a predetermined condition being monitored. In particular, the invention is employed in a multi-zone intrusion system where a single indicator provides an output indicative of all zones which are not secure. The apparatus causes the indicator to blink the zone numbers in a continuous sequence and for example, if zones 2 and 5 were not secure the indicator would provide two flashes indicative of zone 2 and then provide a predetermined pause while then providing 5 flashes indicative of zone 5. The user by counting the flashes can then immediately determine which zones in the plurality of zones have been violated.

12 Claims, 3 Drawing Figures

FAULT INDICATOR APPARATUS FOR A MULTI-ZONE INTRUSION SYSTEM

BACKGROUND OF INVENTION

This invention relates in general to indicating apparatus and more particularly, to an indicating apparatus for use in a multi-zone intrusion system.

There is in existance many different intrusion systems which operate to monitor premises and to transmit suitable warnings for the occurrence of a break-in attempt, such as burglary or to monitor other conditions, such as fire, smoke and so on. Such systems have been generally referred to as intrusion systems and essentially provide an alarm when an unauthorized condition exists on the premises being monitored.

In regard to such systems as presently employed, a central alarm may monitor many zones associated with a given location. For example, in a factory or office complex, a central alarm may be used to indicate an unauthorized condition which exists in one or more locations. It is of course an object of such a central alarm system to indicate to the user which of the particular zones is associated with the unauthorized condition. As such, such systems have an alarm panel to which each zone is connected to indicate the status of the same.

In most present systems each zone would be associated with a separate lamp or other indicator which operates to designate to the user the location of the intrusion. Hence, according to such systems, a separate lamp or other indicator would be necessary to provide an indication for each zone which is being protected by the system. The same panel is also utilized to secure the premises during periods when they are not occupied. Hence, the alarm panel is also used or employed to assure that all zones are intact and therefore have no undesirable instrusion before the system is armed or activated for protection. In many systems a separate number of indicators such as lamps are used to indicate this condition. Hence, as one can see, an alarm panel employed in a multi-zone alarm system can constitute a large number of separate indicating devices each associated with a separate zone being monitored by the system.

It is of course understood that such systems can be expensive due to the large number of indicators, as well as consuming a great deal of power which is necessary to actuate the indicating devices.

The prior art has provided various means for utilizing indicators to distinguish one zone from another. For example, U.S. Pat. No. 3,150,359 entitled Remote Alarm Indicator issued on Sept. 22, 1964 to P. J. Hoey shows a system where any one of a number of different alarm conditions are indicated by separate lamps. In this system each lamp is associated with a separate flashing unit and the operator at the central station or at the alarm panel can determine the particular alarm condition by timing the flashing rate of the lamp.

In other systems such as shown in U.S. Pat. No. 4,103,298 entitled Alarmed Device issued on July 25, 1978 to R. J. Redding, there is described an indicator system which uses different flashing rates to distinguish different alarm conditions.

Other patents such as U.S. Pat. No. 3,757,323 entitled DC Monitoring System Using Two Wire Transmission Lines issued on Sept. 4, 1973 to R. H. Pintell, relate to the use of indicating lamps to determine different alarm conditions during system operation. Still other patents depict various signaling techniques used for various purposes as to reduce power consumption and so on. Example of such patents are U.S. Pat. No. 4,124,842 and U.S. Pat. No. 4,211,956.

In any event, there is a need for a system which is capable of displaying and annunciating an undesirable condition in anyone of a plurality of monitored zones which uses a single indicator as a display. The system thus provided results in a savings in components, as well as a savings in power, in that it uses a single indicator to provide an indication of the zone location which is subjected to an unauthorized intrusion.

BRIEF DESCRIPTION OF THE PREFERRED EMBODIMENT

An indicator apparatus for use in a multi-zone intrusion detection system, said system of the type monitoring a plurality of different zones to detect an intrusion of any ones of said zones, said indicator apparatus employing a single indicator for providing a signal indicative of any ones of said zones indicating an intrusion, comprising means for sequentially accessing each of said zones in said plurality and for providing an output signal at any zone exhibiting an intrusion, means responsive to said sequential access to generate an address of each of said zones, logic means responsive to said address and said output signal to generate a number of pulses indicative of any ones of said zones exhibiting said intrusion, indicating means responsive to said pulses to provide a sequential ON-OFF signal capable of being physically counted indicative of the number of each zone exhibiting said intrusion, said indicating means including a single device which is sequentially pulsed ON an OFF to provide sequential counts of each zone exhibiting said intrusion.

DETAILED DESCRIPTION OF THE FIGURES

Figure 1:
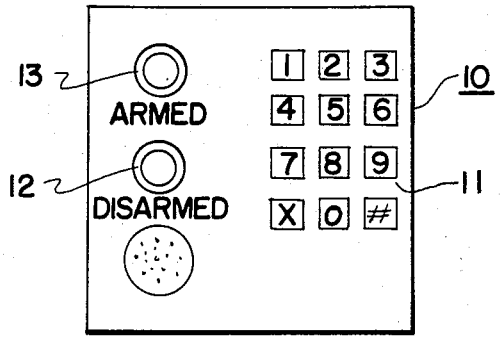
FIG. 1 is a front plan view of an alarm panel useful in explaining the operation of the invention.

For purposes of explaining the invention, reference is made to FIG. 1 which depicts one type of typical control alarm panel 10. The panel 10 contains a telephone like keyboard or keypad 11, which is employed by a user to key in a secret or memorized number operative to arm or disarm the intrusion system.

For example, in a multiple zone system a number of different areas, say for example six, are monitored by separate sensing devices such as intrusion detectors as window and door switches and so on. When the system is to be placed in operation the user would key in the proper number via keypad 11 and if all zones are secured then the armed light would go ON. However, if any zone is not secured as a door or window being left open, then this is an actual alarm condition and arming the system would cause an alarm to go OFF. Thus when the system is not armed or disarmed it is imperative that the user know which of the zones is not secure to enable him to take the proper steps to see that the zone is secured prior to arming the system. As indicated, in order to do this the prior art required a separate indicator for each zone. Hence if there were six zones monitored by the intrusion system, six separate indicators were required to allow one to determine which zone was violated. In the system to be described when the disarmed lamp or LED 12 is indicating a steady glow, this means that all zones are secure and that the system may be armed. However, if one or more zones are not secured, the indicator 12 will blink in a continuous sequence the number of each zone which was not secure.

For example, assume a six zone system and further assume that zones two and five (2 and 5) are not secured. In this instance the indicator 12 will flash or blink as follows: It will blink two times, stay OFF for a predetermined period (1.5 seconds) and then flash or blink five times and stay OFF for the same predetermined period. This sequence keeps on repeating. Hence, the operator by viewing the indicator 12 can now determine that zones two and five are not secured. If any other zone is also not secured, this zone will cause an appropriate blinking of the indicator. The blinking period which indicates the zone number is a 50—50 duty cycle and for example, may be 250 milliseconds "ON" and 250 milliseconds "OFF" with a predetermined OFF period between blinking of about 1.5 seconds. It is of course understood that the time intervals indicated above are by way of example only and that other suitable intervals will suffice as well. It being apparent that the main objective is to enable one to conveniently monitor the flashing or blinking of the indicator to determine the zone or zones which are not secure.

In a similar manner the panel 10 has another indicator lamp 13 which is designated as ARMED. This lamp or LED device may be red in color while the indicator 12 may be green. The indicator 13 will provide a steady glow when the intrusion system has been armed and all zones are secured. If any zone is violated the red lamp 13 will blink as the green lamp to indicate an alarm and to further indicate the zone at which the interruption occurred. The above described operation has been described for a relatively simple control panel utilized with up to six zones or more.

Thus as will be further described the system uses, for example, a single indicator such as 12 to indicate the secured status of six or more different zones by flashing or blinking the zone number which is not secured in a continuous sequence.

Figure 2:
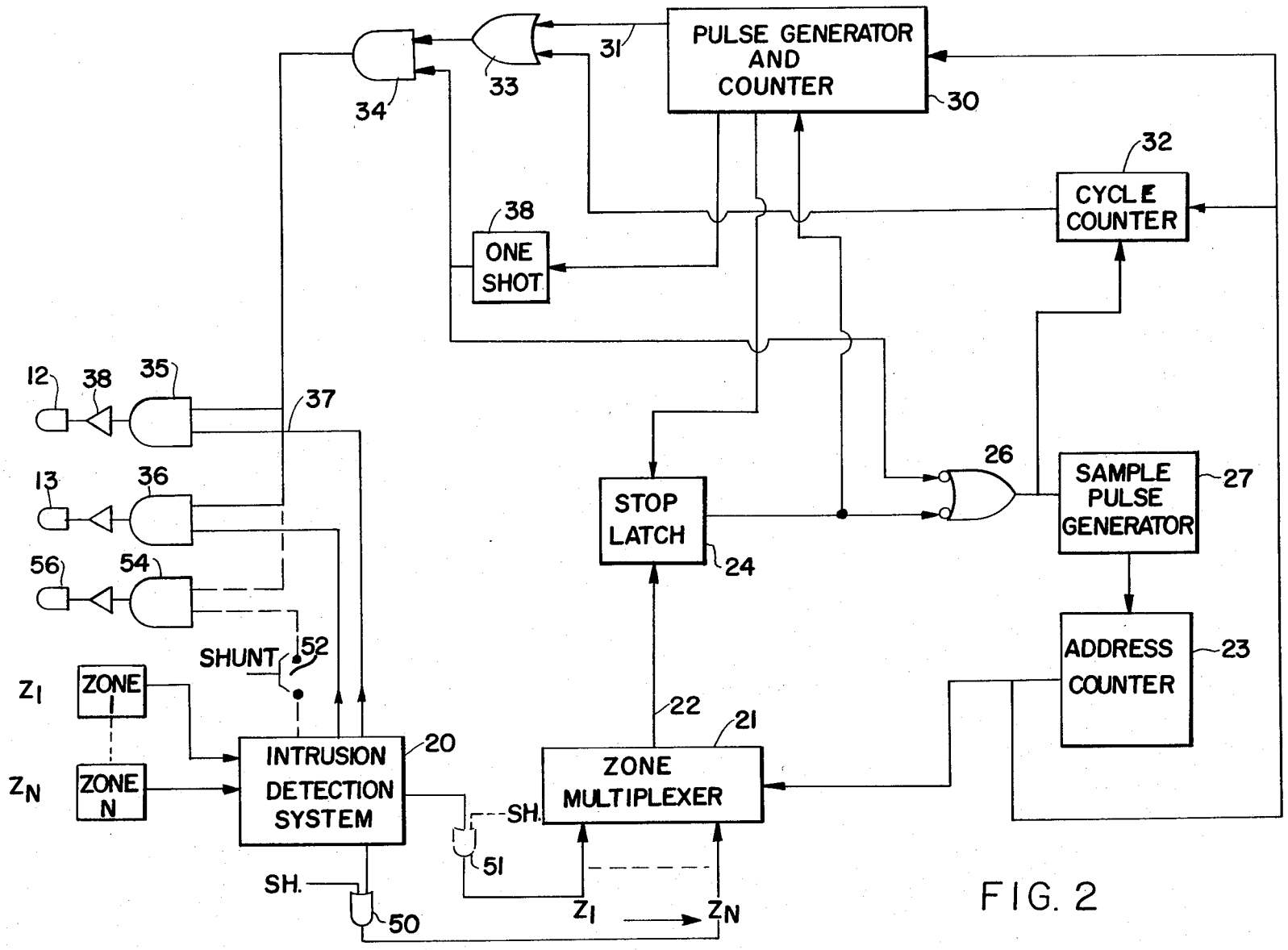
FIG. 2 is a detailed block diagram of the fault indicator apparatus according to this invention.

Referring to FIG. 2, there is shown a block diagram of suitable apparatus used in implementing the above described operation of the indicator.

Numeral 20 references an intrusion detection system which operates to monitor a plurality of different zones as Zone 1 to Zone N. For present purposes the number of zones may be any given number but typically up to six zones are accomodated by the system 20. Each zone or area includes a plurality of intrusion detectors such as window or wall switches, smoke detectors for a fire detection situation, and various other well-known devices. Usually the devices as the switches are wired in a closed loop path and therefore an opening indicative of an intrusion will actuate an alarm. There are of course many alternate approaches to such intrusion systems, but it suffices to state that a violation of a zone is manifested by a low (ground) or a high signal input to the control apparatus associated with the intrusion system 20. The system 20 upon receipt of an alarm signal from one or more zones proceeds to activate a siren, bell or operate a dialer or other mechanism to provide an indication of the alarm condition and therefore to notify the proper persons or authorities. The operation and construction of many types of intrusion detection systems 20 is well-known, as well as the aspect of utilizing such systems for multi-zone operation.

As seen from FIG. 2, the various alarm outputs or status lines associated with each zone are directed as separate leads to the input terminals of a zone multiplexer 21. The multiplexer 21 receives the zone status leads $Z_1$ to $Z_n$ at the inputs and can apply each input to a common output terminal 22. Multiplexers as 21 are well-known in the art and many commercially available circuits exist. See for example a text entitled "Guide Book of Electronic Circuits" by John Markus, McGraw Hill Book Co. (1974), Chapter 73 entitled Multiplexer Circuits. The multiplexer 21 is controlled to sequence or scan the inputs $Z_1$ to $Z_n$ and direct any input to output 22 under control of an address counter 23. The address counter 23 is a digital counter which provides a unique digital code for each zone. The zone inputs $Z_1$–$Z_n$ are sampled or scanned in sequence by the zone multiplexer 21 as controlled by the address counter 23. Coupled to the output 22 of the multiplexer 21 is a stop latch or flip-flop 24 also designated as STOP LATCH. If a zone is intact the stop latch 24 is not operated. However, if a zone is not intact thus indicating a zone violation then the stop latch 24 is triggered during that zone sample by the signal on output line 22. When a zone is in trouble the stop latch 24 is set thus blocking the gate 26. The output of gate 26 is coupled to a pulse generator 27 which supplies stepping pulses to the address counter 23. When a zone is intact the pulse generator 27 applies a pulse to the address counter 23 to cause it to advance the multiplexer to the next zone. However, upon the setting of latch 24 the pulse generator 27 is inhibited and hence the address counter 23 does not advance and the zone sampling process is stopped at that zone.

The output of the address counter 23 is also directed to the input of a pulse generator and counter 30. The pulse generator and counter 30 receives the zone address and provides a pulse output indicative of the zone number. For example, for zone 2, the generator and counter 30 will provide two output pulses on lead 31. The pulse generator and counter 30, also receives an input from the stop latch 24 when it is set. This input gates the pulse generator and counter to store the zone address from the address counter 23. A cycle counter 32 also receives an inhibit signal from gate 26 and this counter 32 has its output coupled to one input of gate 33, the other input of gate 33 is coupled to the output of the pulse generator and counter 30. As indicated above if all zones are intact one would desire the lamp 12 of FIG. 1 (DISARM) to glow continuously indicating that all zones are intact. The cycle counter 32 activates gate 33 which is coupled via AND gate 34 to gates 35 and 36. AND gates 35 and 36 are each associated with a separate indicator as 12 (FIG. 1) for gate 35 or DISARM, and indicator 13 (FIG. 1) for gate 36 (ARMED). The other inputs to gates 35 and 36 emanate from the intrusion system indicative of the status as whether the system is armed or disarmed. Thus if the system is disarmed than gate 35 is activated at input 37. If the system is disarmed and all zones are intact, the LED 12 will be activated continuously via gate 35 and the driver 38. The other input to gate 35 and 36 is coupled or connected to the output of AND gate 34. When all zones are intact the cycle counter 32, activates gate 33. Since all zones are intact gate 34 is also activated and the LED 12 is ON via gate 35. However, if there is a zone that is not intact then the stop latch 24 is activated as explained. The activation of the stop latch 24 causes the cycle counter to trigger removing the activation signal from gate 33 and hence causes the LED 12 to go OFF. The triggering of the stop latch 24 gates the zone address into pulse generator counter 30. This address is converted into a number of pulses indicative of the zone number; as three pulses for zone three and so on. These pulses developed by the pulse generator are applied via gate 33 and gate 34 to gate 35 to cause the LED 12 to blink the zone number.

After the transmission by the pulse generator and counter 30 of the appropriate pulses, a trigger pulse is directed to the one-shot or monostable multivibrator 38. The one shot 38 provides the blanking signal between pulses to block gate 34 and thereby turn OFF the LED 12 via gate 35 for the period determined by the time delay afforded by one shot 38. The output pulse from the one-shot can be of any duration as for example the 1.5 seconds as indicated above or longer.

The output of the one-shot 38 is also directed to gate 26 which assures that the sample pulse generator 27 is not set during the blanking period as the stop latch 24 is reset by the pulse generator and counter 30 when the one-shot 38 is triggered. The cycle counter 30 is also advanced by the address counter 23 and will cause the LED 12 to operate continuously without flashing or blinking if all zones are intact.

With the above description in mind assume that the following conditions exist within the system.

First assume the system is disabled and all zones are intact. In this case all zones leads ($Z_1$ to $Z_n$) as inputs to the zone multiplexer 21 are low. The zone multiplexer is sequenced by the address counter 23 for all zones. The stop latch 24 is not set and therefore the address counter 24 is advanced from zone to zone by the pulse generator 27. The cycle counter 32 is set via the address counter and the output activates OR gate 33 which in turn activates gate 34 since the one-shot 38 is not triggered. Since all zones are intact and since the system is in the DISARMED state, gate 35 is activated and will cause the LED 12 to illuminate continuously. An operator upon noting the continuous illumination of LED 12 can now ARM the system. In this case gate 35 is inactive and gate 36 becomes active and hence LED 13 will blink or flash if an intrusion occurs as above described.

Now let us again assume that the system is disarmed as before but that two zones out of say six zones are not intact. Further assume that these zones are zone #2 and zone #5.

The following operation occurs. As before the multiplexer is advanced in turn by the address counter 33. When zone #2 is accessed the input $Z_2$ to the multiplexer 21 is high. This causes the output 22 to go high thus setting the stop latch 24. The setting of the stop latch 24 inhibits the pulse generator 27 and hence the address counter does not advance but stays at the count indicative of the address of zone #2. The cycle counter 32 is set to remove the high from gate 33 and the LED 12 goes OFF via gates 34 and 35.

The setting of stop latch 24 activates the pulse generator and counter 30 which translates the binary address from address counter 23 to provide two pulses for zone #2 at the output 31. These pulses are applied via gates 33, 34, 35 to the driver 38 to cause the LED 12 to blink or flash twice indicative of zone #2. After the generation of the two pulses, the generator and counter 30 provides a pulse to trigger the one-shot 38. The one-shot 38 causes gate 34 to disable gate 35 for the predetermined duration and hence the LED 12 goes OFF. The pulse also resets the stop-latch 24. At the end of the blinking the pulse generator causes the address counter to advance to the next address which is zone #3. The cycle counter 30 is also enabled and continues to monitor the cycle count, one count for each zone. The cycle counter basically consists of a binary counter which counts to N states. When it reaches a count of N or six in this case it triggers a flip-flop in the counter 32 to indicate that all zones are scanned and they are all intact. This signal via the flip-flop causes a steady high to be applied to gate 33. However if a zone, as zone #2 in this case, is not intact the flip-flop is reset as well as the cycle counter. Thus the counter 32 starts over and tries to count to N or six which will indicate all zones are intact. However it will not reach this count if a zone is not secure. The cycle counter 32 thus continues to count one time for each address change. Since in this example zone #2 was not intact the cycle counter 32 was reset via gate 26 and now starts to advance towards N for intact zones 3 and 4. However zone #5 was also in trouble. When the multiplexer 21 is advanced by the address counter 23 to zone #5, the above sequence again occurs. However, the pulse generator and counter 30 receives the zone #5 address and provides five output pulses to flash the LED 12 five times after which the one-shot 38 is triggered and the LED is again blanked. If the zones are not made intact the process continues with the LED 12 blinking two times and then five times in a continuous mode. If the troubled zones as 2 and 5 are made intact then the cycle counter will reach the count of N as it will not be reset and the LED 12 will glow continuously indicating to the user that all zones are intact and the system can be armed. As one can readily ascertain, once the system is armed gate 36 is activated. Since all zones are intact the LED 13 will glow continuously. If any zone or zones specifies an intrusion then LED 13 will blink out the affected zones as did LED 12 as above described.

Thus the operator or user of this system can tell which of a plurality of zones has been violated or is not secure by viewing two indicators and physically counting the flashes.

There are of course numerous modifications and uses for this concept to enable one to conserve power by reducing the number of indicators while providing a simple and easy indication of the status of multiple zones. For example, in intrusion systems one may not be able to secure a zone as for example a defective switch or a broken wire may render the zone inoperable. In this case the zone would always be in trouble and the system could not be secured. In order to resolve this problem one would "shunt" the zone at the control panel or at the control board. Essentially, a shunt would serve to short out the intrusion detectors to present a continuous low to the multiplexer 21. This low would indicate that the shunted zone was always intact and secure and hence would not cause a blinking of LED 12 or 13.

The same circuitry can provide an indication of all shunted zones as follows: In FIG. 2, gates or inverters as 50 and 51 are employed in each zone lead prior to directing the same to the multiplexer 21. If one desires to shunt a zone then a ground or suitable signal is applied to the inverter as 50 or 51 for zone #1 and zone #N in the shunt mode. This causes a permanent intact signal to be applied to the multiplexer 21 for all shunted zones. When the shunt switch 52 is activated gate 54 is enabled while gates 35 and 36 are disabled. Indicator 56 will then indicate all shunted zones as during this mode the inverters as 50 and 51 will be activated to actually provide a trouble signal at the multiplexer. Since the inverters as 50 and 51 which are activated only when a shunt has been used in the system the inverters will cause the same signal to be applied to the multiplexer 21 indicative of a trouble condition. The operator in the shunt mode then knows which zones have been shunted. All zones not shunted would receive a "no shunt" input and would now indicate an intact. If a zone were in fact in trouble it would be noticed in the disarmed mode via indicator 12.

Thus these and many other options are available to the user in indicating zone failure by the use of the above-noted apparatus. It is further noted that all circuitry depicted is conventional in format and uses conventional digital circuits to implement the same.

Figure 3:
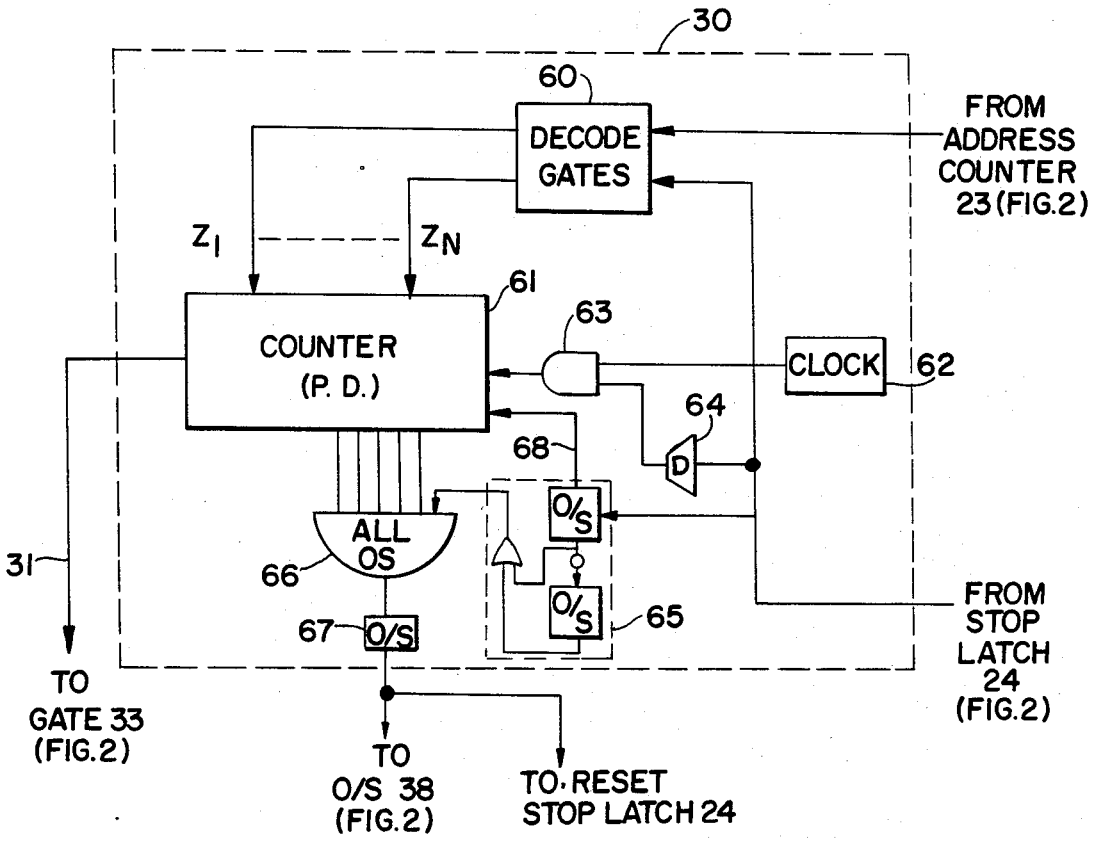
FIG. 3 is a block diagram of a pulse generator and counter used in this invention.

Referring to FIG. 3, there is shown an example of a pulse generator and counter 30 of FIG. 2. It is understood that there are many way of implementing the circuitry. As seen from FIG. 3, the binary address from address counter 23 is applied to decode gates 60. The decode gates 60 are conventional AND gates which decode each address and therefore provide a plurality of outputs indicative of the zones as $Z_1$ to $Z_2$. The outputs from the decode gates are applied to a counter 61. Basically, counter 61 is a programmable divider which essentially is a digital counter consisting of a number of stages in cascade. Such circuits as counter 61 are well-known in the art and will provide a count according to a control signal applied to the control inputs. In this case the control signal is the outputs $Z_1$ to $Z_n$ emanating from the decode gates 60.

Therefore, for example, if zone 5 is present at the address counter the counter 61 will be activated by the zone 5 lead derived from the decode gates 60 to cause the counter to count to 5 or to provide 5 pulses at the output lead 31 which would be applied to the input of gate 33. The counter 61 is stepped or incremented by the clock 62. The clock or pulse generator 62 may comprise an astable multivibrator and provides a symmetrical output signal indicative of a duty cycle necessary to flash or blink the LED. The output of the clock circuit is provided to one input of an AND gate 63.

As above explained, the pulse generator and counter 30 is actuated by the stop latch 24. The output from the stop latch 24 is directed to the decode gates 60 allowing the gates to provide the decoded zone number to the counter 61 to cause the counter to provide the necessary output pulses. The stop latch is also applied to another input of AND gate 63 through a delay circuit 64. When the stop latch signal is generated the inhibit circuit 65 is activated, the inhibit circuit may consists of cascaded one-shots. The purpose of circuit 65 is to inhibit the all zero gate 66 from operating the reset one-shot 67 at the beginning of the generation of the stop latch signal. Gate 66 operates to detect an all zero condition.

Essentially, when a counter completes its program count it will return to all zeros. In this application the return of the counter 61 to the all zero state indicates that the counter has provided a number of output pulses on lead 31 indicative of the particular zone as defined by the address. The purpose of the circuit 65 is to prevent the generation of the all zero signal initially. As one can see, when the stop latch 24 signal is present a one-shot in module 65 in triggered. This one-shot resets the counter 61 to all zeros and in turn inhibits gate 66 from operation. A second one-shot is also triggered to assure that gate 66 will be inhibited during the transition of the counter from the all zero count to the first transition. When the counter or divider 61 has provided the correct count a proper number of pulses have been transmitted via lead 31 and the counter as programmed automatically returns to the all zero state. This is detected by gate 66 which triggers the one-shot 67. This signal in turn activates the one-shot 38 of FIG. 2 and resets the stop latch 24 as explained.

It is of course understood that there are many ways of accomplishing the above noted operation and as for example, the text cited above has many examples of programmable dividers or counters which can be adapted to produce a number of pulses according to a programmed input. As one can now ascertain by reviewing FIG. 2, the entire operation described above can be simply accomodated by a use of a microprocessor. Essentially, the microprocessor contains input lines which are coupled to the zone input leads as to multiplexer 21. Such microprocessors also contains address and cycle counters. The entire circuitry and operation, as above described, can therefore be implemented in a microprocessor in a relatively simple and straight forward circuit.

It is further noted that the microprocessor also contains memory capability and therefore the status of each zone can be stored in memory and further this memory can then be accessed to enable a user to determine which zones were not intact after the zones have been secured. This feature is known in the art as alarm memory and is simply provided in utilizing the above described apparatus or in utilizing a microprocessor option. While a preferred way of providing zone indication has been shown using a lamp or a light indicating device, it is also understood that the pulses generated could be coupled to activate a speaker and therefore provide an audible sound as a series of beeps which can be counted by the user to determine the monitored zones which are producing the trouble signals or trouble condition.

Essentially, the heart of this invention resides in the fact that a single indicating device is pulsed ON and OFF in a continuous sequence, wherein each bunch of pulses is indicative of the number of the zone which has been violated or which has been shunted. If all zones have been violated then the sequence would provide a number of pulses separated by a blanking interval to enable a user to count each number and therefore derive information indicative of other zones which are not intact. These and other features of the invention will become apparent to those skilled in the art upon reading the above noted specimen and all such modifications and alternative embodiments are deemed to be encompassed within the scope of the claims appended hereto.

I claim:

1. An indicator apparatus for use in a multi-zone intrusion detection system, said system of the type monitoring a plurality of different zones to detect an intrusion of any ones of said zones, said indicator apparatus employing a single indicator for providing a signal indicative of any ones of said zones indicating an intrusion, comprising:

(a) means for sequentially accessing each of said zones in said plurality and for providing an output signal at any zone exhibiting an intrusion;

(b) means responsive to said sequential access to generate an address of each of said zones;

(c) logic means responsive to said address and said output signal to generate a number of pulses indicative of any ones of said zones exhibiting said intrusion;

(d) indicating means responsive to said pulses to provide a sequential ON-OFF signal capable of being physically counted indicative of the number of each zone exhibiting said intrusion, said indicating means including a single device which is sequentially pulsed ON and OFF to provide sequential counts of each zone exhibiting said intrusion.

2. The indicator apparatus according to claim 1, wherein said indicating means comprises a light emitting indicator.

3. The indicator apparatus according to claim 1, wherein said means for sequentially accessing each of said zones comprises multiplexing means having a plurality of inputs, one for each of said zones and operative to direct any one of said inputs to a common output, a control input associated with said multiplexing means for receiving a control signal for determining which of said inputs is coupled to said output.

4. The indicator apparatus according to claim 3, wherein said means responsive to said sequential access comprises an address counter having an output coupled to said control input of said multiplexing means, said address counter generating address signals one for each of said zones to cause said multiplexing means to couple any of said inputs to said output of said multiplexing means according to said address signal.

5. The indicator apparatus according to claim 4, wherein said logic means includes:

a pulse generator and counter having an input coupled to said address counter for receiving an address of said zone and having another input coupled to the output of said multiplexer for receiving a signal indicative of an intrusion, said pulse generator operative to provide a number of pulses indicative of the zone number exhibiting said intrusion, and means responsive to said number of pulses being generated to provide a blanking signal of a given interval whereby when more than one zone exhibits an intrusion a first number of pulses indicative of a first zone separated by said blanking interval is followed by a second number of pulses indicative of a second zone and so on.

6. Indicator apparatus for providing an indication of which ones of a plurality of sequentially numbered zones being monitored are associated with a common characteristic being monitored to provide an indication of all zones having the monitored common characteristic, comprising:

(a) means for scanning said zones and for providing an output signal for each zone in said plurality when said monitored common characteristic is present;

(b) means responsive to the zone being scanned to provide an output indicative of the address of said zone;

(c) means responsive to said output signal and to said address to provide a number of pulses manifesting the number of said zone exhibiting said monitored characteristic as compared to any other zone;

(d) single indicating means responsive to said pulses to provide an indication signal manifesting the number of said pulses, whereby if more then one zone exhibits said monitored characteristic, said single indicator means will provide said indication signal in sequence indicative of all zones having said characteristic.

7. The indicator apparatus according to claim 6, wherein said zones are zones in an intrusion detection system and said common monitored characteristic is the security status of said zone as being intact or not intact.

8. The indicator apparatus according to claim 7, wherein said single indicating means comprises a single light emitting device operative as controlled to blink ON and OFF according to said number of pulses, whereby said blinking can be physically counted to indicate a number for each of said zones which are not intact.

9. In an intrusion detection system of the type capable of monitoring a plurality of zones from one to N, where any one or ones of said zones can provide a status output signal indicative of an intrusion, which signal may produce an alarm as detected by said intrusion detection system, the combination therewith of indicator apparatus for providing an indication of any one or ones of said zones providing said status signal, comprising:

(a) multiplexer means having a plurality of input terminals one for each of said zones for receiving said status signals, an output terminal for coupling any selected one of said status signals at said input terminals thereto, a control input for receiving a control signal determinative of which one of said inputs is coupled to said output terminal;

(b) address counting means operative to provide a separate address for each of said zones at an output terminal, with said output terminal of said address counting means coupled to said control input of said multiplexing means;

(c) latching means having an input coupled to said output terminal of said multiplexing means and operative to provide a stop signal at an output when any status signal appears on said output terminal to said multiplexing means, including means coupled to said address counting means for inhibiting an address change when said stop signal is provided;

(d) pulse generating means responsive to said address of said zone providing said status signal and responsive to said stop signal to generate a number of pulses manifesting a count indicative of said zone and including means responsive to the generation of said number of pulses to reset said latching means;

(e) single indicating means coupled to said pulse generating means and operative to provide a series of ON-OFF signals capable of being physically counted to indicate the number of all of said zones providing said status signal in a continuous sequence whereby said indicating means provides a first number of pulses indicative of the number of a one of said zones providing said status signal and a second number of pulses indicative of the number of another of said zones providing said status signal and so on to cause an indication to be provided for every zone providing said status signal in a continuous sequence with each number of pulses indicative of each zone capable of being physically differentiated.

10. A method of indicating which ones of a plurality of zones being monitored is providing a status being monitored, comprising the steps of:

(a) providing a signal for all zones being monitored having said status;

(b) providing a number of pulses indicative of an assigned number for each zone;

(c) pulsing an indicator ON and OFF according to said number of pulses for each zone in a continuous sequence, whereby said pulsing provides a first number of ON and OFFS for a first zone and a second number of ON and OFFS for another zone and so on with each number of ON and OFFS capable of being physically counted to indicate said zone.

11. The method according to claim 10, wherein said zones being monitored are zones in an intrusion detection system, with said status being monitored being whether said zones are secure.

12. The method according to claim 11, wherein said indicator comprises a light emitting device which is pulsed ON and OFF in sequence to cause blinking wherein the number of blinks is an indication of the zone number.

* * * * *